US006588745B2

(12) United States Patent
Gosslinghof

(10) Patent No.: US 6,588,745 B2
(45) Date of Patent: Jul. 8, 2003

(54) METHOD AND DEVICE FOR CHANGING THE HOLD OF FLAT ARTICLES BEING CONVEYED HELD BY GRIPPERS

(75) Inventor: Reinhard Gosslinghof, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/055,549

(22) Filed: Jan. 23, 2002

(65) Prior Publication Data

US 2002/0096418 A1 Jul. 25, 2002

(30) Foreign Application Priority Data

Jan. 24, 2001 (CH) ..... 0121/01

(51) Int. Cl.[7] ..... B65H 5/00

(52) U.S. Cl. ..... 271/225; 271/184; 271/204; 271/69; 198/470.1

(58) Field of Search ..... 198/470.1, 457.03; 271/225, 184, 204, 69

(56) References Cited

U.S. PATENT DOCUMENTS

| | | | | | |
|---|---|---|---|---|---|
| 3,617,054 | A | * | 11/1971 | Schilling | 271/69 |
| 4,201,377 | A | | 5/1980 | Honegger | |
| 4,320,894 | A | * | 3/1982 | Reist et al. | 271/277 |
| 4,408,560 | A | * | 10/1983 | Caratsch | 118/69 |
| 4,893,805 | A | | 1/1990 | Eberle | |
| 4,896,874 | A | * | 1/1990 | Muller | 271/186 |
| 5,029,843 | A | * | 7/1991 | Kobler | 271/204 |
| 5,110,116 | A | * | 5/1992 | Kobler et al. | 271/277 |
| 5,295,679 | A | * | 3/1994 | Reist | 271/182 |
| 5,395,151 | A | * | 3/1995 | Eberle | 294/104 |
| 5,819,663 | A | * | 10/1998 | Klaas et al. | 101/483 |
| 6,003,859 | A | * | 12/1999 | Reist | 271/204 |
| 6,047,960 | A | * | 4/2000 | Kawano et al. | 271/184 |
| 6,092,804 | A | * | 7/2000 | Wingate | 271/276 |
| 6,158,735 | A | * | 12/2000 | Cote et al. | 271/302 |
| 6,196,538 | B1 | * | 3/2001 | Stauber et al. | 271/69 |
| 6,237,744 | B1 | * | 5/2001 | Reist | 198/465.4 |
| 6,270,076 | B1 | * | 8/2001 | Reist | 271/302 |
| 6,435,583 | B1 | * | 8/2002 | Reist | 294/116 |
| 6,457,708 | B2 | * | 10/2002 | Honegger | 271/204 |

FOREIGN PATENT DOCUMENTS

| | | |
|---|---|---|
| CH | 617 408 A5 | 5/1980 |
| CH | 667 636 A5 | 10/1988 |
| DE | 214 440 C | 9/1972 |
| EP | 0 754 642 A2 | 1/1997 |
| EP | 0 990 535 A1 | 4/2000 |

* cited by examiner

*Primary Examiner*—Christopher P. Ellis
*Assistant Examiner*—Rashmi Sharma
(74) *Attorney, Agent, or Firm*—Rankin, Hill, Porter & Clark LLP

(57) ABSTRACT

Flat articles (3) each held by a feeding-in gripper (5) on a leading first edge are fed-in to a hold changing station (1) one after the other, are pulled onto a changing support situated in the changing station (1), and are deposited on it by opening the feeding-in gripper (5). Each deposited article is then pushed across the changing support (10) by a conveying-away gripper (6) and, while being pushed, is grasped by closing the conveying-away gripper (6) and is conveyed away held gripped on a second edge. Advantageously, the feeding-in direction (Z) and the conveying-away direction (W) intersect above the changing support (10) under the one angle (α), which is also constituted by the first and the second edge. For the hold change of rectangular printed products, the angle (α) amounts to 90°. For pushing the articles, the conveying-away grippers (6) move in the plane of the surface of the changing support and are driven from below. For articles (3) that overlap one another on being fed-in, the feeding-in grippers (5) move above the surface of the changing support (10) and are driven from above.

19 Claims, 3 Drawing Sheets

Fig.2
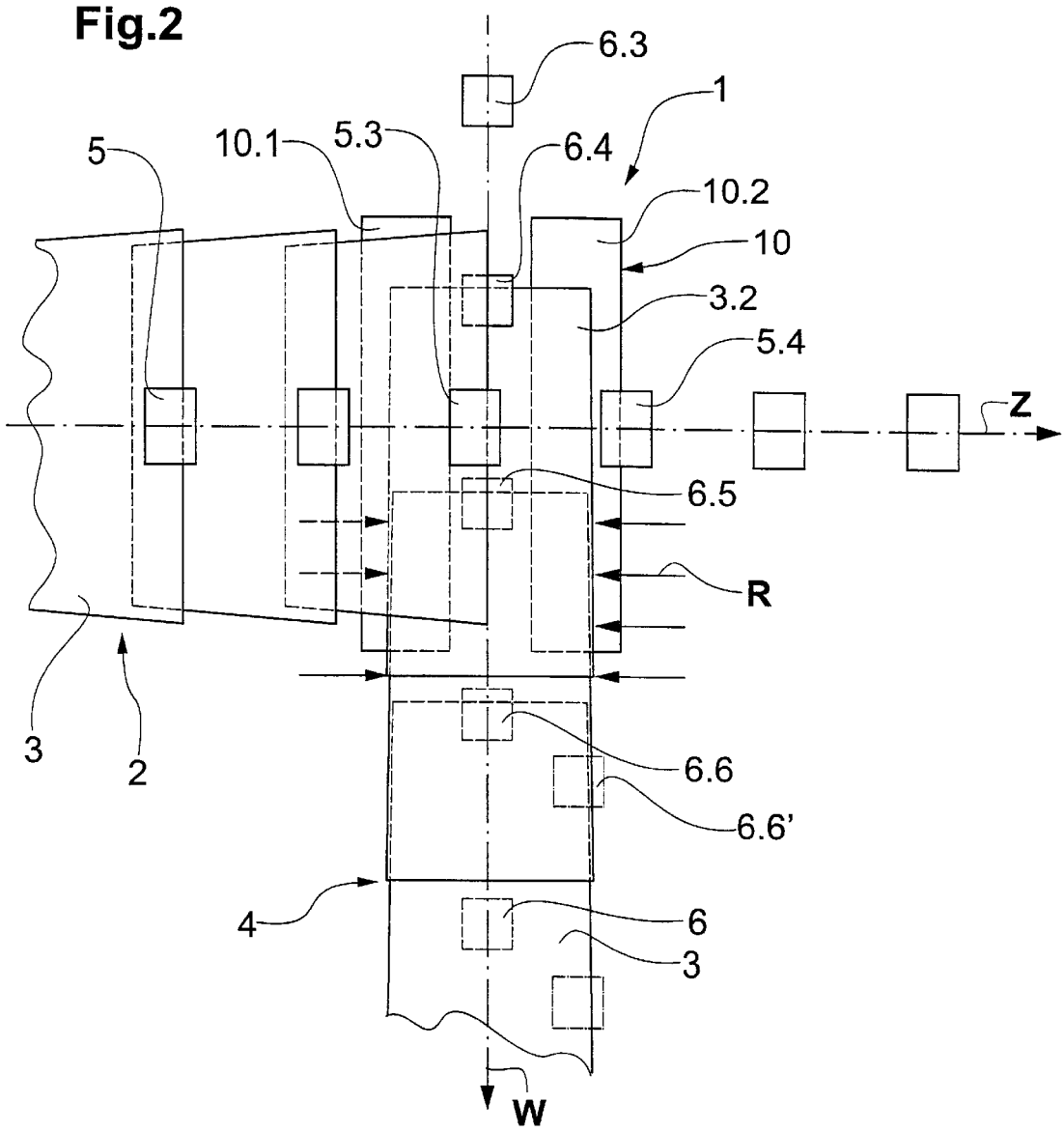
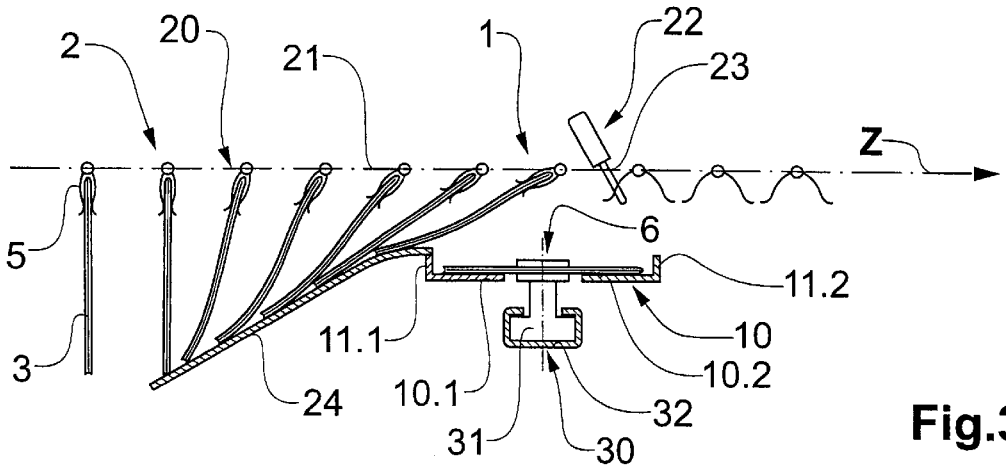
Fig.3

METHOD AND DEVICE FOR CHANGING THE HOLD OF FLAT ARTICLES BEING CONVEYED HELD BY GRIPPERS

BACKGROUND OF THE INVENTION

1. Field of the Invention

The present invention is situated in the field of materials handling technology and is generally related to a method and a device for changing the hold of flat articles being conveyed held in a gripped manner and, more particularly, for changing the hold of printed products being conveyed one after the other in an continuous stream, wherein every flat object or printed product is held by a gripper in an edge zone.

2. Description of the Related Art

Changing the hold is to be understood as a process in which every one or a predetermined selection of articles each being conveyed in a held manner by a first gripper is taken over by a second gripper, wherein the first gripper grips the article in a first edge zone and the second gripper grips the article in a second edge zone different from the first one.

A device for changing the hold of printed products conveyed in a held manner is known, for example, from the publication EP-0305671 (or U.S. Pat. No. 4,893,805). This device comprises a feeding-in device and a conveying-away device, both of which comprise a traction organ and grippers arranged thereon. The feeding-in device supplies the printed products in a substantially freely suspended manner, i.e., gripped in an upper edge zone. Upstream of the changing station, the lower parts of the freely suspended printed products are guided onto a supporting surface and in this manner are retarded relative to the gripped edges. This means that the products are brought into an inclined position such that their lower edges trail behind the gripped upper edges. The products reach the changing station in such an inclined orientation. In the area of the changing station, the grippers of the conveying-away device move along a track below the conveying track of the feeding-in device and aligned to it. The movements of the grippers of the feeding-in device and of conveying-away device are parallel and synchronized such that, at the changing station, every gripper of the conveying-away device meets with a lower edge zone of a printed product being fed-in and is capable of grasping the printed product lower edge zone. Actuation of the grippers of the two conveying devices is synchronized such that the conveying-away gripper is closed before the feeding-in gripper is opened. Accordingly, there is no moment in which the product is not gripped. The feeding-in gripper is opened as rapidly as possible after the closing of the conveying-away gripper.

Devices in accordance with the mentioned publication have the advantage that conveyance of the printed products through the changing station is continuous and always guided in a precisely defined manner and that, nonetheless, the printed products are never strained or tensioned between the two grippers. The device therefore provides a very high conveyance security and is therefore applicable for highly sensitive printed products. These advantages, however, are achieved only if the feeding-in and conveying-away and the gripper actuation are exceedingly accurately synchronized. Furthermore, the changing process is limited to a change from a hold on one edge to a hold on the opposite edge or from a hold of one zone to another zone of the same edge, and the device is dependent on the format of the products. Furthermore, the change demands a fairly long, substantially parallel conveyance of the feeding-in and conveying-away grippers. This is particularly true if the conveying-away grippers have to catch up with the trailing edges of the products in order to position these edges in the gripper mouths.

For changing the hold on a first edge of a printed product to a hold on a second edge perpendicular to the first edge according to prior art, a conveying stream of gripped printed products is transformed into an imbricated stream, in which the products are lying loosely on a conveying surface. The imbricated stream is turned around by 90°, or the individual products are turned around by 90°, and the products are thereupon gripped again by conveying-away grippers. Because product guidance in an imbricated stream is less accurate than in a gripped stream, the security and the precision of such a method is significantly lower than in the case of a direct hold changing operation. A device in which an imbricated stream is turned around is disclosed, for example, in the publication CH-617408 (or U.S. Pat. No. 4,201,377).

SUMMARY OF THE INVENTION

It is an object of the invention to create a method and a device for changing the hold of flat articles being conveyed in a held manner. It is a further object of the inventive method and device, on the one hand, to be simpler than corresponding methods and devices according to prior art and, nonetheless, not to be subject to their limitations. Therefore, using the method and device according to the invention it is possible to feed-in the flat articles held gripped in a first edge zone and to convey them away held gripped in a second edge zone, the two edges being oriented at right angles or at an oblique angle to one another. The method and the device according to the invention provides a security and holding accuracy satisfying very high demands, even in the case of very high conveying capacities.

In accordance with the method according to the invention, flat articles are held by feeding-in grippers in a leading edge zone and are pulled one after the other onto a changing support. The flat articles are positioned one after the other on the changing support by opening each gripper, and each article deposited on the changing support is pushed off the support by an open conveying-away gripper before the next article is deposited. The conveying-away gripper acts on a trailing edge zone different from the edge zone being acted on by the feeding-in gripper. During the pushing action, the conveying away gripper is closed while the article is still being held in a stable position by the changing support. The pushing movement and the conveying-away take place in one direction (conveying-away direction), which intersects with the feeding-in direction in the area of the changing station.

The pushing action can be effected as mentioned above by the conveying-away grippers. It can also be effected by other suitable pushing means, such as, for example, pusher cams. Independent of the pushing means, the articles are grasped by the conveying-away grippers while being pushed. However, if pushing means different from the conveying-away grippes are used, it becomes possible to grasp the articles in an edge zone different from the edge zone being acted on by the pushing means.

Before the conveying-away gripper is closed, the articles, if so required, can be subjected to lateral alignment.

For a high conveying capacity and relatively low conveying speed, it is advantageous to overlap the articles with one another both during the feeding-in as well as during the conveying-away. In this case, the articles are arranged in the feeding-in stream such that their gripped, leading edges are on top of the stream. In the conveying-away stream the leading edges are on top of the stream also, however, the leading edges are not the gripped edges.

The projections of the feeding-in direction and of the conveying-away direction on the surface of the changing support intersect at an angle. The intersecting angle advantageously corresponds to the angle between the edges held on feeding-in and the edges held on conveying-away. This means that, for rectangular articles being fed-in gripped at a longer edge and being conveyed away gripped at a shorter edge, the angle between the two conveying directions advantageously amounts to 90°.

It becomes manifest, in particular when utilising the invention for conveying printed products, that also in the case of very high conveying capacities and very dense conveying streams (i.e., for distances between products of approximately 10 cm at edge lengths of up to approximately 60 cm and for conveying speeds of up to approximately 1 to 2 m/sec) it is possible, to carry out the hold changing process in accordance with the invention with an adequate security and accuracy. As such, the demands of the synchronisation accuracy between feeding-in and conveying-away are significantly lower than is the case with known systems for hold changing. Furthermore, the dependence of the device on article format is significantly lower than has been the case up until now. As long as the edge zone held gripped during feeding-in and the edge zone acted on during pushing (i.e., for rectangular or square-shaped products one product corner) are aligned to a reference position, the device does not have to be modified or readjusted for handling products of differing formats.

The device according to the invention comprises a feeding-in device with feeding-in grippers, a conveying-away device with conveying-away grippers, and a changing support. The conveying-away device may further comprise separate pushing means. The changing support is arranged horizontally or inclined. The two conveying devices are arranged such that their grippers are driven from opposite sides, for example, one set of them from above, the other set from below. For the pushing function, the conveying-away grippers or the pushing means, respectively, move advantageously substantially in the plane of the surface of the changing support and are driven from below. For this purpose, the changing support comprises at least two independent parallel parts, between which the grippers move driven from below. It is also possible to provide gripper pairs driven from below, of which one gripper respectively moves on each side of the changing support, which, in this case, is narrower than the handled articles.

If the articles overlap one another in the feeding-in stream and in the conveying-away stream, the feeding-in grippers being driven from above move above the changing support and at a distance from it. If the articles do not overlap, the feeding-in grippers may move in the same plane as the conveying-away grippers and the grippers of the two kinds traverse each other's paths in a comb-like manner.

The two conveying devices comprise, for example, conveying organs on which the grippers are arranged at equal distances, or they comprise rail tracks along which conveying elements with one gripper each are conveyed in a more or less independent manner. For synchronizing grippers arranged on conveying elements being independent of one another, the conveying elements need to be brought into phase for the hold changing process.

For opening and closing the grippers in the zone of the changing support, actuating cams are provided and the grippers comprise corresponding control rollers rolling along the cams. If not all the fed-in articles are to be subjected to the hold changing operation, the grippers will be selectively controlled.

The feeding-in device advantageously further comprises a means for braking the fed-in articles after being released from the feeding-in grippers. Such braking means keep the articles from overshooting the changing support due to their own momentum.

In the zone of the changing support there are advantageously aligning means being aligned in the direction of the conveying-away. These aligning means serve for laterally aligning the articles deposited on the changing support while being released by the feeding-in gripper and/or while being pushed across the changing support by the conveying-away grippers or the pushing means.

BRIEF DESCRIPTION OF THE DRAWINGS

These and further features of the invention will be apparent with reference to the following description and drawings, wherein:

FIG. 2 is a top view of a schematically illustrated, exemplary embodiment of the device according to the invention;

FIG. 3 shows an exemplary embodiment of the device according to the invention (viewing direction essentially parallel to the changing support and transverse to the feeding-in direction);

DETAILED DESCRIPTION OF THE PREFERRED EMBODIMENTS

Figure 1:
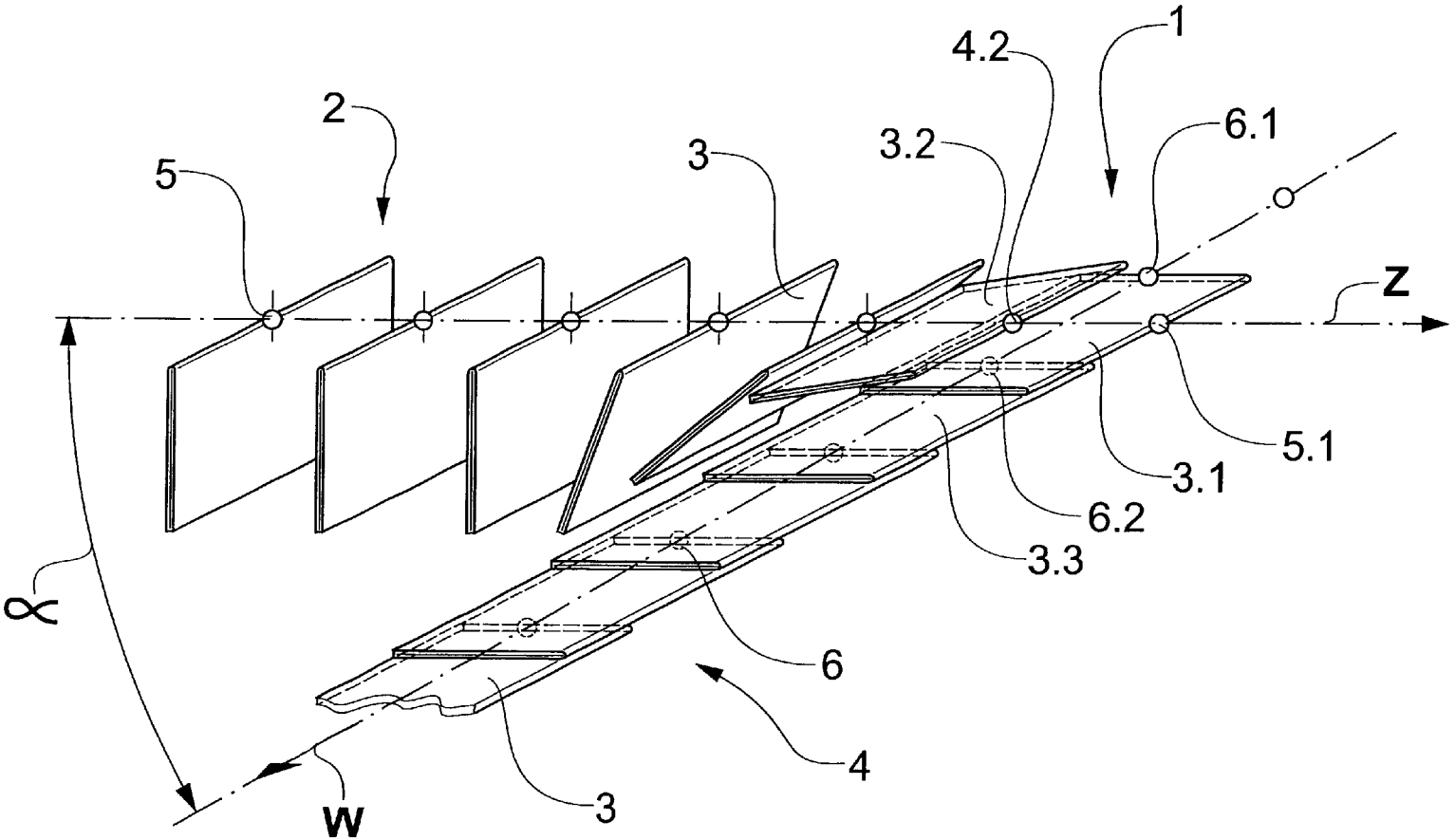
FIG. 1 is a three-dimensional illustration of a feeding-in stream and a conveying-away stream of flat articles, which in a hold changing station being operated according to the invention are released from feeding-in grippers and are taken over by conveying-away grippers.

FIG. 1 is a very schematic, three-dimensional illustration of a hold changing station 1 being operated in accordance with the invention. A feeding-in stream 2 of flat articles 3 is fed-in to the station in a feeding-in direction Z and is transformed into a conveying-away stream 4 of articles being gripped and conveyed away in a conveying-away direction W. The illustrated articles 3 are rectangular in shape and are fed-in held at their longer edges and conveyed away held at their shorter edges. Naturally, this orientation may be reversed. The longer and shorter edges are at right angles to one another. The feeding-in direction Z and the conveying-away direction W are advantageously in parallel planes at a distance from one another and their projections onto the plane of the conveying away direction (surface of the changing support) intersect at a corresponding angle $\alpha$ of 90°.

The feeding-in grippers 5 grip the articles at their upper edges and convey them, for example, freely suspended towards the hold changing station 1. Upstream of the hold changing station 1, the lower edges of the articles 3 are retarded such that the upper gripped edges become the leading edges. In this position the articles 3 are pulled onto a changing support (not shown) and are released by the feeding-in gripper as soon as they have reached a predefined position relative to the changing support. On being released, the articles if so required drop onto the changing support, the dropping distance being as short as possible.

FIG. 1 depicts the article 3.1 at a moment, in which it is being released by the feeding-in gripper 5.1, in order to be pushed immediately afterwards in the conveying-away direction W by the conveying-away gripper 6.1. If the articles 3 in the feeding-in stream 2 and in the conveying-away stream 4 overlap, the article 3.1 being pushed across the changing support by the conveying-away gripper 6.1 is partially covered by the following article 3.2 being pulled onto the changing support or on the article 3.1, respectively, by a further feeding-in gripper 4.2. Similarly, a preceding article 3.3 is pushed across the changing support by a further conveyingaway gripper 6.2 underneath the article 3.1. The further conveying-away gripper 6.2 is advantageously already closed in the moment of time depicted.

At least immediately before being deposited on the changing support, the articles 3 in the feeding-in stream 2 have leading edges lying on top of the stream and are held by the grippers at these leading edges. In the conveying-away stream 4, the articles also have leading edges lying on top of the stream, now, however, they are held at the trailing edges lying on the bottom side of the stream. In order to transform the conveying-away stream 4 into a conveying stream in which the articles are once again conveyed in a suspended manner, the conveying-away grippers 6 are, for example, rotated by 180° around the conveying away direction W in an as such known manner (refer to FIG. 4).

FIG. 2 illustrates an exemplary embodiment of the device in accordance with the invention from a bird's eye view. The hold changing process to be implemented with this device corresponds substantially to the process as depicted in FIG. 1. Identical parts are designated with the same reference numbers as in FIG. 1. FIG. 2 also shows the changing support 10, which in the illustrated embodiment consists of two parallel parts 10.1 and 10.2 that are spaced from one another. The feeding-in grippers 5 move above the changing support 10. The conveying-away grippers 6 move in the zone of the surface of the changing support 10, i.e. through the clearance between the parallel parts 10.1 and 10.2, and they protrude above the surface of the changing support. The conveying paths of the feeding-in grippers and of the conveying-away grippers can also intersect, if synchronisation is such that the two gripper types do not interfere with one another.

Of the feeding-in grippers 5, the gripper 5.3 is still closed, the gripper 5.4 is already opened. Of the conveying-away grippers 6, the grippers 6.3 and 6.4 are open, while gripper 6.5 is open or closed, and gripper 6.6 closed. The arrows R indicate lateral aligning means for laterally aligning the downstream part of an article 3.2 being pushed across the changing support 10.

As mentioned further above, instead of the conveying-away grippers 6, separate pushing means moved in the same manner (e.g., pusher cams) may be utilised for the pushing function. Such pushing means protrude above the surface of the changing support 10 and are driven from below. In such a case, the pushing means designated as 6.3, 6.4 and 6.5 in FIG. 2 would therefore not be grippers, but rather, for example, pusher cams and, instead of by the grippers designated as 6.6 and 6, the articles to be conveyed away would be grasped laterally by conveyingaway grippers 6.6' and 6' (indicated with dot-dash lines) being laterally displaced relative to the pusher cams, and they would be conveyed away without changing the conveying-away direction. The conveying-away grippers 6.6' and 6' co-operating with the pusher cams may hold one article each or several articles overlapping one another.

Figure 4:
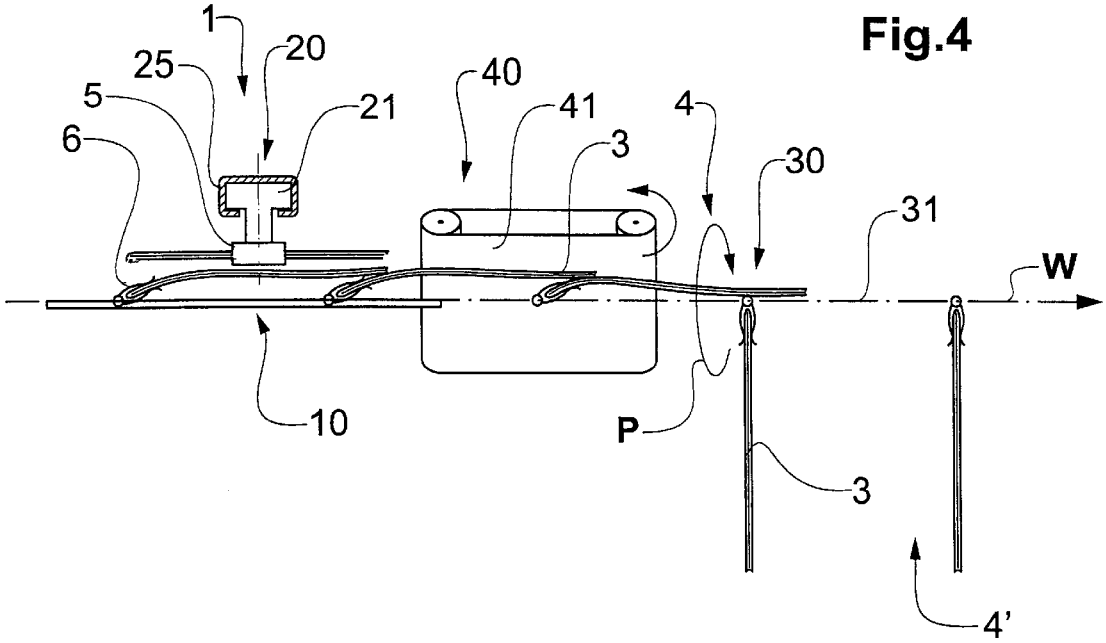
FIG. 4 shows an exemplary embodiment of the device according to the invention (viewing direction essentially parallel to the changing support and transverse to the conveying-away direction)

FIGS. 3 and 4 show further exemplary embodiments of the. device according to the invention viewed substantially parallel to the changing support 10, in FIG. 3 transverse to the feeding-in direction Z, in FIG. 4 transverse to the conveyingaway direction W.

FIG. 3 depicts the feeding-in device 20, which as a conveying organ (dot-dash line 21) comprises a chain or a multitude of conveying elements displaceable along a rail track. The feeding-in grippers 5 are arranged on the feeding-in organ 21 and are capable of being swivelled relative to it parallel to the feeding-in direction Z. Furthermore, there is a braking means 22, e.g. comprising two brake bars 23 capable of being run out and into the feeding-in stream 2 on both sides of the feeding-in grippers 5. The breaking means serve for braking an article 3 to be subjected to the changing process such that it is deposited on the changing support 10 as accurately as possible.

The conveying-away device 30 of FIG. 3 is illustrated in a section transverse to the conveying-away direction (orientated towards the viewer). It comprises a conveying organ 31, e.g. a chain or a multitude of conveying elements, which conveying organ is guided within a channel 32. The channel 32 is arranged underneath the changing support 10 such that the conveying-away grippers 6 extend above the surface of the changing support 10 and act on articles 3, which are lying on the surface of the changing support.

The changing support 10 comprises two parallel parts 10.1 and 10.2 spaced from one another and aligned in the conveying-away direction. The changing support is equipped on the feeding-in side with a running-up ramp 24, which retards the lower edges of the fed-in articles 3 relative to their upper edges, as illustrated.

The changing support 10 further comprises upward-facing rims 11.1 and 11.2 directed upwardly and extending on both sides in the conveying-away direction. Articles 3 released by the feeding-in grippers 5 are guided laterally between the rims 11.1, 11.2 on being deposited on the changing support 10 and on being pushed across the changing support 10.

FIG. 4 illustrates essentially the same embodiment of the device in accordance with the invention as FIG. 3, this time viewed transverse to the conveying-away direction W. The feeding-in device 20 is sectioned transverse to the feeding-in direction (oriented towards the viewer). In the same manner as the conveying-away device 30 of FIG. 3, the feeding-in device comprises a conveying organ 21 that is guided within a channel 25, the feeding-in grippers being arranged on the conveying organ 21. Of the conveying-away device 30 the conveying organ 31 (as a dot-dash line) and conveying-away grippers 6 are illustrated, the conveyingaway grippers being designed for swivelling parallel to the conveying-away direction W.

FIG. 4 also shows a further, exemplary means 40 for the lateral alignment of the preceding parts of articles 3 during deposition on the changing support 10 and/or during their pushed movement across the changing support 10. This alignment device 40 comprises two circulating belts 41, each of which is arranged on one side of the conveying-away direction. The belts 41 are driven in circulation such that their part directed against the articles 3 moves in the conveying-away direction and has substantially the same speed as the conveying-away grippers 6.

In the conveying away-stream 4 established during the hold changing operation, articles 3 overlap one another and have leading edges lying on top of the stream. By rotating (arrow P) the conveying-away grippers 6 around the conveying organ 31, this conveying-away stream 4 can be transformed into a further conveying away-stream 4', in which the articles 3 are conveyed essentially freely suspended. Such rotation is possible only at a distance from the changing support 10.

Figure 5:
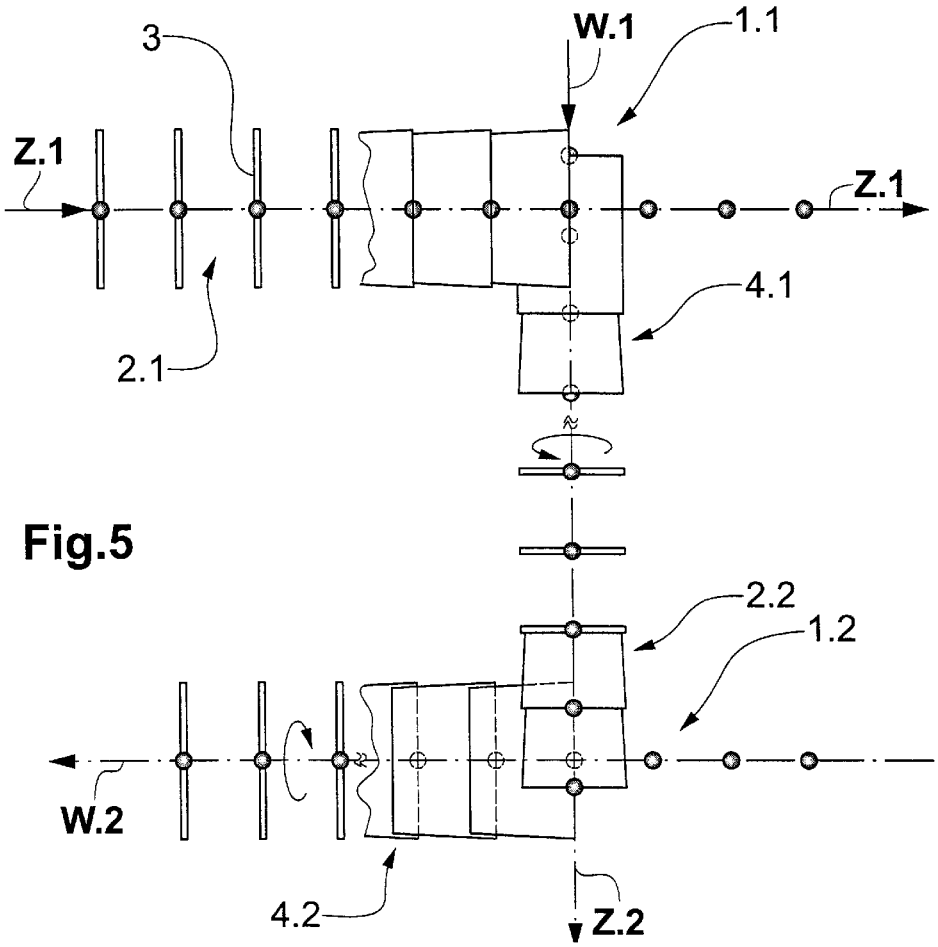
FIG. 5 shows a combination of two hold changing stations operated according to the invention.

FIG. 5 shows in a similar representation as FIG. 2 a combination of two hold changing stations 1.1 and 1.2 operated according the invention. The articles 3 are fed-in, as described above, in a first feeding-in stream 2.1 in essence freely suspended and, at the first hold changing station 1.1, they are subjected to a first hold changing operation of the kind as shown in FIG. 1. The first conveying-away stream 4.1 in which the articles are conveyed away from the station with trailing gripped edges lying on the bottom side of the stream is transformed by rotation by 180° around the first conveying-away direction W.1 into a second feeding-in stream 2.2, in which the articles 3 are conveyed once again essentially freely suspended. The second feeding-in stream 2.2 is subjected at the second hold changing station 1.2 to a second hold changing operation and thereby is transformed into a second conveying-away stream 4.2. In the second conveying-away stream 4.2, the articles are gripped on edges opposite the edges gripped in the first feeding-in stream 2.2.

FIG. 5 gives the impression that at both hold-changing stations 1.1 and 1.2 all articles are subjected to the hold changing operation. This, however, is not a condition. At every hold changing station 1.1 and 1.2 it is possible to take only selected ones of the articles from the feeding-in stream 2.1 and 2.2 and to further convey the articles remaining in the feeding-in stream, for example to one or more further hold changing stations. This signifies that there may be plural hold changing stations along the conveying path of the feeding-in grippers, the conveying-away direction at each hold changing station being independently selectable. The conveying-away directions may, for example, be parallel to one another or opposed to one another. A device with a plurality of hold transfer stations may be utilised for splitting streams or capacities.

What is claimed is:

1. A method for changing a hold of flat articles (3) being conveyed in a held manner, the method comprising the steps of:

feeding-in the articles in to a hold changing station (1) one after the other in a feeding-in direction (Z), the articles being held by feeding-in grippers (5) in a leading first edge zone, pulling each article onto a changing support (10) situated in the hold changing station (1), depositing each article on the changing support (10) by opening the corresponding feeding-in gripper (5), pushing the deposited article across the changing support (10) in a conveying-away direction (W) with the aid of a conveying-away gripper (6) or another pushing means acting on the articles (3) in a trailing second edge zone, taking hold of the article while it is being pushed by closing the pushing conveying-away gripper (6) around a trailing second edge zone or a conveying-away gripper arranged laterally of the pushing means around a lateral third edge zone, and conveying away the articles one after the other in the conveying-away direction (W), wherein the feeding-in direction (Z) and the conveying-away direction (W) intersect in an area of the hold changing station.

2. The method according to claim 1, wherein the first edge and the second edge of the articles (3) form an angle ($\alpha$) and the projections of the feeding-in direction (Z) and the conveying-away direction (W) intersect at said angle on a surface of the changing support (10).

3. The method according to claim 2, wherein the angle ($\alpha$) is a right angle.

4. The method according to claim 1, wherein the articles (3) overlap one another during the feeding-in and are conveyed with their leading edges situated on the upper surface of the stream and the feeding-in grippers (5) are moved above the changing support (10) and, at least in the area of the changing support (10), are driven from above.

5. The method according to claim 4, wherein, for being conveyed away, the articles (3) overlap one another and have their leading edges situated at the upper side of the stream and the conveying-away grippers (6) or pushing means are moved essentially in a plane of the surface of the changing support (10) and, at least in the area of the changing support (10), are driven from below.

6. The method according to claim 5, wherein the conveying-away grippers (6) together with the articles to be conveyed away are rotated by 180° around the conveying-away direction (W) after leaving the area of the changing support (10).

7. The method according to claim 1, wherein the articles (3) are pushed across the changing support (10) by pushing means and, while being pushed, the articles are taken hold of by the conveying-away grippers (6.6'. 6') in edge zones being aligned parallel to the conveying-away direction.

8. The method according to claim 1, wherein the articles are laterally aligned on being deposited on the changing support (10) and/or on being pushed across the changing support (10).

9. The method according to claim 1, wherein the articles (3) are braked following opening of the feeding-in grippers (5).

10. A device for changing a hold of flat articles (3) being conveyed in a held manner, the device comprising:

a feeding-in device (20) with feeding-in grippers (5) for the held feeding-in of articles (3) in a feeding-in direction (Z) to a hold changing station (1), a conveying-away device (30) with conveying-away grippers (6) for the held conveying-away of the articles (3) in a conveying-away direction (W) from the hold changing station (1), control means for opening the feeding-in grippers (5) and for closing the conveying-away grippers (6) in an area of the hold changing station (1), and a changing support (10) situated at the hold changing station (1), wherein the feeding-in device (20), the conveying-away device (30) and the changing support (10) are arranged for the feeding-in direction (Z) and the conveying-away direction (W) to lead across the surface of the changing support and to intersect, and wherein conveyance of the feeding-in grippers (5) and of the conveying-away grippers (6) is synchronized and the control means are designed for the feeding-in grippers (5) to be opened when a held article (3) has reached a predefined position on the changing support (10), for the conveying-away grippers (6) or other pushing means moving in the conveying-away direction to reach an edge zone of the article (3) when the article is deposited on the changing support (10), and for the conveying-away grippers (6) to be closed while the article (3) is being pushed across the changing support (10).

11. The device according to claim 10, wherein the feeding-in device (20) and the conveying-away device (30) are arranged such that the projections of the feeding-in direction (Z) and of the conveying-away direction (W) intersect on the surface of the changing support (10) under an angle ($\alpha$) of 90°.

12. The device according to claim 10, wherein the changing support (10) comprises at least two parallel parts (10.1 and 10.2) aligned in the conveying-away direction (W) and at a distance from one another and the conveying-away device (30) is designed and arranged such that the conveying-away grippers (6) move substantially in a plane of the surface of the changing support (10) and are driven through the space between the parallel parts (10.1 and 10.2).

13. The device according to claim 10, wherein the changing support (10) comprises at least two parallel parts (10.1 and 10.2) aligned in the conveying-away direction (W) and at a distance from one another, the device further comprises pushing means protruding above the surface of the changing support (10) and driven through the space between the two parallel parts (10.1 and 10.2) to move in the conveying-away direction (W) and the conveying-away device (30) is arranged such that the conveying-away grippers (6) are laterally displaced relative to the pushing means.

14. The device according to claim 12, wherein, at least within the area of the hold changing station (1), the feeding-in device (20) is designed and arranged such that the feeding-in grippers (5) move above the surface of the changing support and are driven from above.

15. The device according to claim 10, wherein the control means are control cams and the feeding-in and/or the conveying-away grippers (5, 6) comprise control rollers rolling along the control cams.

16. The device according to claim 10, wherein, on its feeding-in side, the changing support (10) comprises a running-up ramp (24) for retarding lower parts of articles (3) being fed-in in a suspended manner.

17. The device according to claim 10, further comprising alignment means (11.1, 11.2, 40) for laterally aligning at least the leading parts of the articles (3) on being deposited on the changing support (10) and/or on being pushed across the changing support (10).

18. The device according to claim 10, wherein it further comprises a braking means (22) for braking the articles (3), when they are released by the feeding-in grippers (5).

19. Use of the method according to claim 1 for changing the hold of rectangular printed products from a longer edge to a shorter edge and vice versa.

* * * * *